United States Patent [19]

Hillman

[11] 4,190,015

[45] Feb. 26, 1980

[54] APPARATUS FOR DISPENSING LIQUID TO SPINNING WORKPIECES

[75] Inventor: Gary Hillman, Livingston, N.J.

[73] Assignee: Machine Technology, Inc., Whippany, N.J.

[21] Appl. No.: 858,516

[22] Filed: Dec. 8, 1977

[51] Int. Cl.[2] ..... B05B 13/04; B05C 5/00

[52] U.S. Cl. ..... 118/696; 118/321; 427/85; 427/240

[58] Field of Search ..... 118/6, 7, 52, 54, 302, 118/321; 427/3, 82, 85, 240; 214/1 BT

[56] References Cited

U.S. PATENT DOCUMENTS

| | | | |
|---|---|---|---|
| Re. 5,876 | 5/1874 | Hitchcock . | |
| 174,612 | 3/1876 | Aldrich . | |
| 2,899,929 | 8/1959 | Monroe | 118/302 |
| 2,960,060 | 11/1960 | Chatterton . | |
| 3,339,522 | 9/1967 | Shaffer et al. | 118/6 |
| 3,359,938 | 12/1967 | Klemmer | 118/6 |
| 3,391,671 | 7/1968 | Windsor | 118/6 |
| 3,403,658 | 10/1968 | Damm et al. | 118/6 |
| 3,494,326 | 2/1970 | Upton | 118/52 X |
| 3,521,599 | 7/1970 | Bentzinger | 118/6 |
| 3,645,581 | 2/1972 | Lasch, Jr. et al. | 214/1 BT X |
| 4,056,075 | 11/1977 | Seiderman | 118/321 X |
| 4,062,463 | 12/1977 | Hillman et al. | 214/1 BT X |
| 4,068,019 | 1/1978 | Boeckl | 427/82 |

OTHER PUBLICATIONS

IBM Technical Disclosure Bulletin, Use of a Venturi to Accomplish Resist Splatter Dispersal, A. J. LaRue, vol. 17, No. 11, Apr. 1975.

Rand, Jr., W. M., *Mechanical Applications of Flowed-In Gaskets*, Rubber Age, pp. 477–481, Jan. 1953.

*Primary Examiner*—Robert Mackey

*Attorney, Agent, or Firm*—Lerner, David, Littenberg & Samuel

[57] ABSTRACT

A liquid dispenser is disclosed which is arranged to dispense a fixed amount of liquid on a workpiece and is then moved away from the workpiece so that no further drops of the liquid fall on the workpiece.

5 Claims, 4 Drawing Figures

APPARATUS FOR DISPENSING LIQUID TO SPINNING WORKPIECES

BACKGROUND OF THE INVENTION

This invention relates to dispensing apparatus and, more particularly, to apparatus for dispensing liquid onto a workpiece and for preventing further drops from falling on the workpiece.

In the processing of materials for the ultimate manufacture of electronic circuit components, one of the steps required may be the dispensing of a fixed amount of a certain type of liquid onto the surface of a workpiece. For example, in the manufacture of integrated circuits, a dopant material may be dispensed onto a silicon wafer for subsequent fusion in a furnace. Additionally, in the manufacture of printed circuit components, a photoresist material may be dispensed onto a substrate preliminary to photoetching of the substrate. In both of these examples, a fixed amount of a dispensed liquid is deposited upon the workpiece surface and is then spread evenly thereon, for example by spinning the workpiece at a high rate of speed. The exact amount of dispensed liquid is not particularly critical, however it is critical that after the dispensing no further drops of the liquid may be dispensed thereon.

Whenever a liquid is dispensed through an orifice, and a valve supplying the liquid to the orifice is closed, the liquid of its own weight forms a final drop. In the situations described above, this final drop would cause the workpiece to be rejected because if the final drop comes down after the workpiece begins spinning, it creates a discontinuity in the surface of the workpiece and if the spinning is delayed until after the final drop comes down, due to the volatility of the solvents in the liquids, there would be too much drying of the liquid before the spinning. Therefore, this final drop must be prevented.

To prevent the dispensing of this final, late drop, the prior art has devised apparatus for dispensing a fixed amount of liquid through a nozzle and then sucking back the liquid that was left at the end of the nozzle in order to prevent the formation of the final drop. This requires a complicated series of diaphragms, pumps, and the like, which is relatively expensive.

It is therefore an object of this invention to provide apparatus for dispensing a fixed amount of liquid onto a workpiece.

It is another object of this invention to provide such apparatus wherein after the fixed amount of liquid is dispensed, no further amount of the liquid falls on the workpiece.

It is yet another object of this invention to provide such apparatus which is simple in design and economical in cost.

SUMMARY OF THE INVENTION

The foregoing and additional objects are attained in accordance with the principles of this invention by providing liquid dispensing apparatus comprising a dispensing nozzle, liquid supply means connected to the nozzle for supplying liquid thereto, the liquid supply means including valve means for selectively controlling the flow of liquid to the nozzle, means for moving the nozzle between a first position situated above a region to which the liquid is to be dispensed and a second position removed from the region, and a means for controlling the moving means and the valve means so that the valve means interrupts the flow of liquid and the moving means moves the nozzle from the first position to the second position substantially simultaneously.

In accordance with an aspect of this invention, a reservoir is provided below the second position to capture subsequent drops from the nozzle.

BRIEF DESCRIPTION OF THE DRAWING

The foregoing will be more readily apparent from reading the following description in conjunction with the drawings in which.

DESCRIPTION OF THE PREFERRED EMBODIMENT

Figure 1:
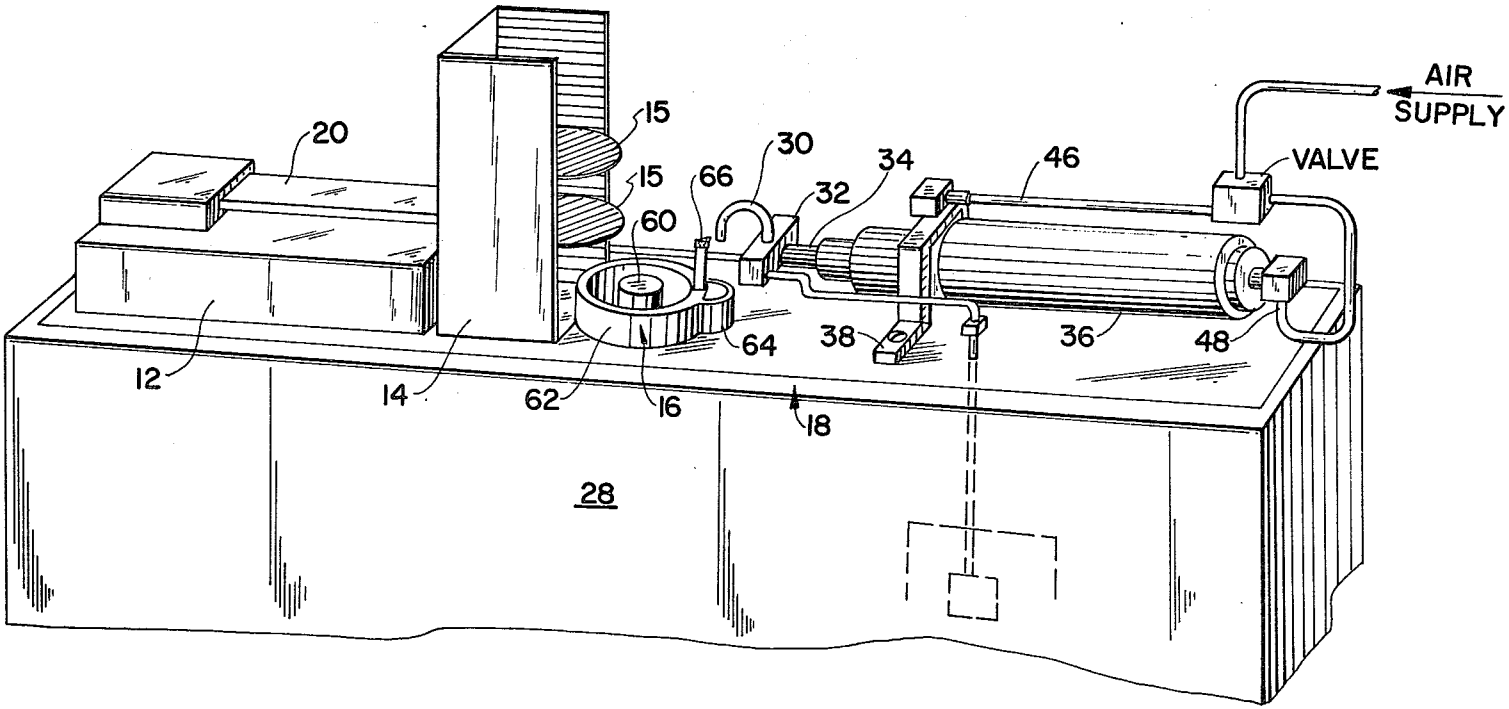
FIG. 1 depicts a perspective view of apparatus constructed in accordance with the principles of this invention.

Referring now to the drawings, wherein like reference numerals in different figures denote like parts, depicted therein is apparatus constructed in accordance with the principles of this invention for dispensing a fixed amount of liquid onto the surface of a workpiece. The apparatus according to this invention is particularly adapted for use with automated workpiece transfer apparatus such as that disclosed in copending U.S. Pat. application Ser. No. 685,303, filed May 11, 1976, now U.S. Pat. No. 4,062,463, granted on Dec. 13, 1977, entitled "Automated Single Cassette Load Mechanism for Scrubber" and assigned to the assignee herein. This apparatus includes transfer means 12, a cassette 14 for housing a plurality of workpieces 15 upon which liquid is to be dispensed, a processing station 16 including chuck 60 for receiving the workpieces upon which the liquid is to be dispensed, and a dispense mechanism 18. All of the foregoing are in longitudinal alignment on a frame member 28 and with the exception of dispensing apparatus 18, are fully described in the aforementioned copending application and the reader is referred thereto for a detailed description. Only as much detail as is necessary for an understanding of the present invention will be described hereinafter.

Cassette 14 includes a plurality of slots for holding a plurality of workpieces 15 in stacked relationship. Illustratively, workpieces 15 are circular silicon wafers. As described in the aforementioned Pat. application, cassette 14 is positioned on an elevator mechanism for moving cassette 14 in a vertical direction so as to sequentially index the different slots of cassette 14 into alignment with workpiece transfer arm 20 of transfer means 12. Transfer arm 20 then extends through cassette 14 to pick up a workpiece, illustratively by vacuum means. Chuck 60 is caused to ascend and the extension of transfer arm 20 deposits the selected workpiece on chuck 16. Transfer arm 20 then retracts and chuck 60 descends. Nitrogen gas is then blown onto the workpiece on chuck 60 for drying the workpiece and removing loose particles therefrom. A cleaning agent such as xylene is then dispensed onto the workpiece, by a dispense mechanism other than dispense mechanism 18. Chuck 60 is then spun at high speed to dry the workpiece. At this time, the dispense apparatus 18 is operated, in a manner to be described hereinafter, to dispense the desired liquid onto the workpiece. Chuck 60 is then caused to spin at a low speed in order to spread the dispensed liquid evenly over the workpiece. Chuck 60 is then caused to spin at a high speed and nitrogen is blown onto the workpiece to dry the workpiece. The workpiece is then unloaded from chuck 60 and redeposited into cassette 14 by causing chuck 60 to ascend at the same time that workpiece transfer arm 20 extends through cassette 14 to pick up the workpiece from chuck 60. Chuck 60 then descends and workpiece transfer arm 20 retracts, bringing the workpiece back into its slot within cassette 14. Cassette 14 is then caused to index the next slot position therein into alignment with workpiece transfer arm 20, and the aforedescribed cycle is repeated.

In accordance with the principles of this invention, the liquid dispensing step includes the following sequence of operations. When it is desired to dispense the liquid, the dispensing nozzle is extended so as to be substantially centered over the workpiece. A valve in the liquid supply line is open for a set period of time to allow the liquid to be dispensed. At the termination of the set period of time, the valve is closed, and simultaneously therewith the dispense head is retracted to a position over a reservoir, so that any further drops of liquid that fall from the nozzle are captured by the reservoir and do not fall upon the workpiece. This dispensing apparatus is shown in detail in the drawings.

Figure 2:
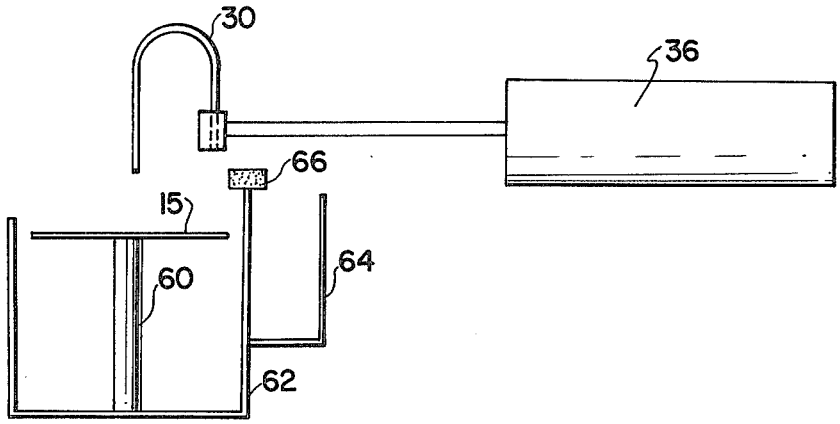
FIG. 2 schematically depicts a partial side elevational view of the apparatus of FIG. 1 showing the apparatus in its dispense position.
Figure 3:
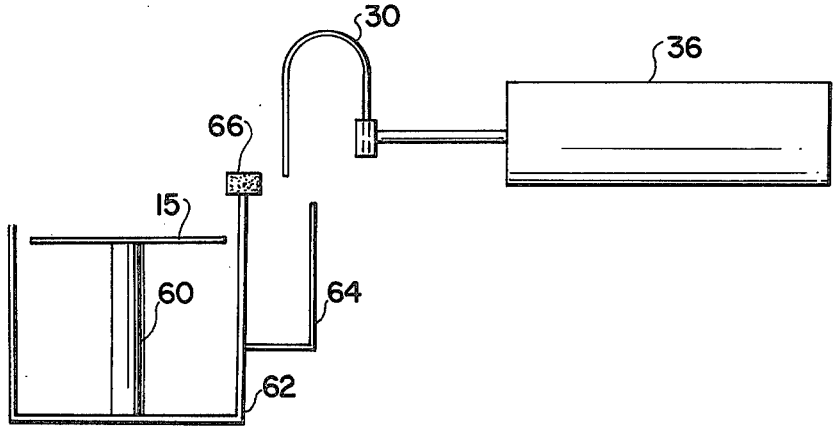
FIG. 3 schematically depicts a partial side elevational view of the apparatus of FIG. 1 showing the apparatus in its retracted position.

The dispensing apparatus 18 includes a nozzle 30. Nozzle 30 is illustratively a length of hollow tubing and extends through an aperture provided for that purpose in a block 32. Block 32 has a threaded bore therein which is screwed onto piston rod 34 of double acting air cylinder 36. Air cylinder 36 is mounted in a conventional manner to bracket 38 which in turn is mounted in a conventional manner to frame 28. Chuck 60 is disposed within a housing, or well, 62, the purpose of which is to retain therein liquid which flies off the workpiece on chuck 60 when chuck 60 is spun at a high rate of speed. A reservoir 64 for capturing drops from nozzle 30 is mounted external to housing 62. As shown in FIG. 2, with the dispensing apparatus in its dispense position, the end of nozzle 30 from which liquid is dispensed is approximately centered over chuck 60. As shown in FIG. 3, when the dispensing apparatus is in its retracted position, the end of nozzle 30 is disposed over reservoir 64.

Figure 4:
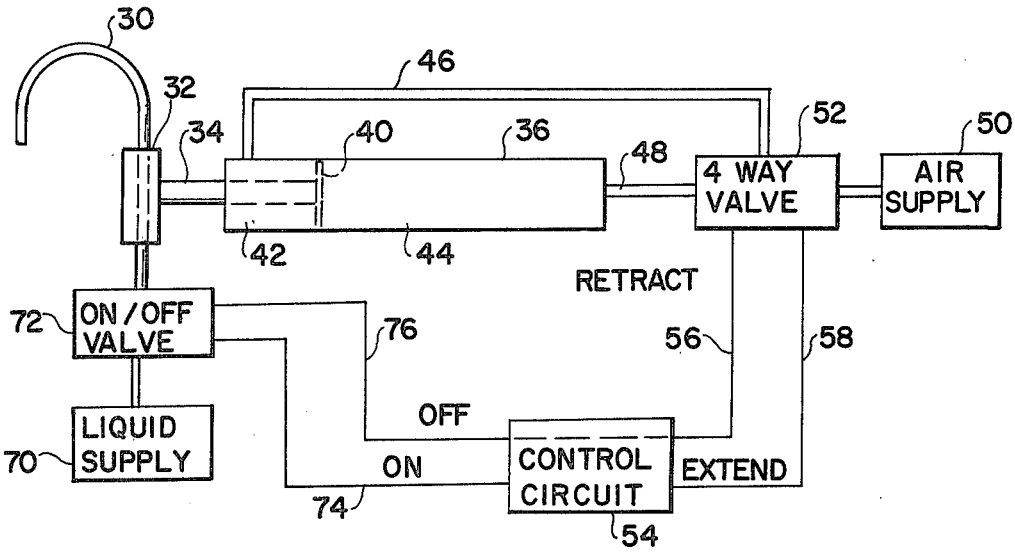
FIG. 4 depicts in schematic form the control of the dispensing and moving of the apparatus constructed in accordance with the principles of this invention.

Referring now to FIG. 4, the operation of the dispensing apparatus in accordance with the principles of this invention will now be described in greater detail. Air cylinder 36 is a double acting cylinder having an internal piston 40 dividing the cylinder into a left side air chamber 42 and a right side air chamber 44, piston 40 being connected to piston rod 34. When air under pressure is introduced into left side air chamber 42 through air line 46, piston 40 is caused to move toward the right, thereby causing nozzle 30 to be retracted. When air under pressure is introduced into right side air chamber 44 through air line 48, piston 40 is caused to move to the left, thereby extending nozzle 30. Air lines 46 and 48 are connected to air supply 50 through four-way solenoid valve 52. Valve 52 operates in response to control signals from control circuit 54 over lines 56 and 58. When a control signal is applied to retract control line 56, four-way valve 52 operates in such a manner that pressurized air from air supply 50 is applied to air line 46. When a control signal is applied to extend control line 58, four-way valve 52 operates to couple air line 48 to air supply 50.

Nozzle 30 is connected to liquid supply 70 through on/off solenoid valve 72. Valve 72 is controlled by signals applied to on and off control leads 74 and 76 by control circuit 54. When a control signal is applied to control lead 74, valve 72 opens to allow liquid from supply 70 to be dispensed through nozzle 30. When a control signal is applied to control lead 76, valve 72 is closed to terminate the dispensing.

In FIG. 4, leads 56 and 76 are shown as being connected together in dotted line fashion through control circuit 54. This is to illustrate the fact that valve 72 is turned off substantially simultaneously with retraction of dispense nozzle 30. When it is desired to dispense liquid from nozzle 30 onto a workpiece, control circuit 54 places a signal on extend control lead 58 to cause dispense nozzle 30 to be moved over the center of chuck 60. After dispense nozzle 30 has been extended, a signal is applied to control lead 74 to open valve 72. Valve 72 is allowed to remain open for a fixed period of time in order to dispense the desired amount of liquid. At the end of this fixed period of time, signals are applied substantially simultaneously to lead 76 and retract lead 56 to close valve 72 and at the same time retract dispense nozzle 30 from its position over chuck 60 to a position over reservoir 64. Therefore, any further drops of the liquid will be captured by reservoir 64. Preferably, valve 72 actually stops dispensing liquid, just before nozzle 30 is moved from its position over chuck 60.

Additionally, it may be desired to provide a cleaning station 66 in the path of travel of nozzle 30 so as to wipe off the nozzle after each dispensing operation.

Accordingly, there has been described apparatus for dispensing liquid onto a workpiece and for preventing further drops from falling on the workpiece. It is understood that the above described embodiment is merely illustrative of the application of the principles of this invention. Numerous other arrangements may be devised by those skilled in the art without departing from the spirit and scope of this invention, as defined by the appended claims.

What I claim:

1. In a machine for dispensing liquid to workpieces which are to be coated by spinning said workpieces to disperse said liquid, liquid dispensing apparatus, comprising:

a dispensing nozzle for dispensing said liquid over a central area of a workpiece which is spun to disperse said liquid outwardly from said central area over the surface of said workpiece;

liquid supply means connected to said nozzle for supplying liquid thereto, said liquid supply means including valve means for selectively controlling the flow of liquid to said nozzle; and means for preventing the undesired dispensing of liquid onto said workpiece including moving means for moving said nozzle between a first position situated above said central area of said workpiece to which said liquid is to be dispensed and a second position beyond the periphery of said workpiece, and control means for controlling said moving means and said valve means so that said moving means moves said nozzle from said second position to said first position and said valve means allows liquid to be dispensed, and so that said valve means interrupts the flow of liquid and said moving means moves said nozzle from said first position to said second position substantially simultaneously so that while said nozzle is being moved from above the central area of said workpiece to beyond the periphery of said workpiece, undesired dispensing of liquid on said workpiece is prevented.

2. The machine according to claim 1 wherein said control means operates said valve means to interrupt the flow of liquid just prior to moving said nozzle from said first position.

3. The machine according to claim 1 further including a reservoir below said second position to receive any undesired liquid which is dispensed.

4. The machine according to claim 1 wherein said moving means includes:

a double acting air cylinder having an internal piston;

a rod connected to said piston and extending through one end of said cylinder; and means for mounting said nozzle on said rod.

5. The machine according to claim 1 further including means for wiping said nozzle as it is moved between said first and second positions.

* * * * *